US011969108B2

(12) United States Patent
Jalali

(10) Patent No.: US 11,969,108 B2
(45) Date of Patent: Apr. 30, 2024

(54) CONVERTIBLE DISPLAY ASSEMBLY

(71) Applicant: Alireza L. Jalali, Naperville, IL (US)

(72) Inventor: Alireza L. Jalali, Naperville, IL (US)

( * ) Notice: Subject to any disclaimer, the term of this patent is extended or adjusted under 35 U.S.C. 154(b) by 0 days.

(21) Appl. No.: 17/373,455

(22) Filed: Jul. 12, 2021

(65) Prior Publication Data

US 2022/0007859 A1 Jan. 13, 2022

Related U.S. Application Data

(60) Provisional application No. 63/050,872, filed on Jul. 12, 2020.

(51) Int. Cl.

| | |
|---|---|
| ***A47G 1/14*** | (2006.01) |
| ***A47G 1/06*** | (2006.01) |
| ***A47G 1/16*** | (2006.01) |

(52) U.S. Cl.

CPC ..... *A47G 1/142* (2013.01); *A47G 1/0638* (2013.01); *A47G 1/162* (2013.01)

(58) Field of Classification Search

CPC ..... A47G 1/142; A47G 1/0638; A47G 1/162; A47G 1/0605; A47G 1/06; F16M 13/005; F16M 2200/08; G09F 1/12; G09F 3/20; G09F 7/18; G09F 15/00; G09F 15/0012

USPC ..... 40/761, 765, 766, 606.01; 248/450, 455, 248/456, 553.41, 224.7, 224.8, 225.11, 248/220.21, 220.22

See application file for complete search history.

(56) References Cited

U.S. PATENT DOCUMENTS

| | | | | |
|---|---|---|---|---|
| 2,328,806 | A * | 9/1943 | Hoofer | G09F 3/18 40/658 |
| 2,447,460 | A * | 8/1948 | Forsyth | A47G 1/142 248/460 |
| 2,449,907 | A * | 9/1948 | Olin | A47G 1/142 248/463 |
| 3,694,947 | A * | 10/1972 | Mukai | A47G 1/142 40/745 |
| 4,216,936 | A * | 8/1980 | DeSelms | A47G 1/142 248/909 |
| 4,229,892 | A * | 10/1980 | Hueter | A47G 1/162 248/470 |
| 4,441,268 | A * | 4/1984 | Scott | A47G 1/142 40/661 |
| 4,655,428 | A * | 4/1987 | McCrea | A47G 1/162 40/761 |
| 4,704,814 | A * | 11/1987 | Astolfi | A47G 1/142 40/761 |
| 4,776,117 | A * | 10/1988 | Astolfi | A47G 1/142 40/761 |
| 6,010,017 | A * | 1/2000 | Michaelis | A47F 7/146 211/205 |
| 6,282,827 | B1 * | 9/2001 | Holmes | A47G 1/142 40/748 |
| 10,371,310 | B1 * | 8/2019 | Schulter | F16M 11/2078 |

(Continued)

*Primary Examiner* — Gary C Hoge

(74) *Attorney, Agent, or Firm* — von Briesen & Roper, s.c.

(57) ABSTRACT

A convertible display assembly is disclosed. The convertible display assembly includes a display sleeve, a connector attached to the back of the display sleeve and forming a connector plate cavity, and a support bracket. The support bracket has a connector plate that is received by the connector plate cavity between the connector and the display sleeve to demountably attach the display sleeve to the support bracket.

19 Claims, 4 Drawing Sheets

(56) References Cited

U.S. PATENT DOCUMENTS

| | | | | |
|---|---|---|---|---|
| 2011/0219655 | A1* | 9/2011 | Rowland | G09F 3/204<br>40/642.01 |
| 2018/0184818 | A1* | 7/2018 | Gaar | G09F 7/10 |
| 2020/0359812 | A1* | 11/2020 | Clores | A47G 1/06 |

* cited by examiner

CONVERTIBLE DISPLAY ASSEMBLY

CROSS-REFERENCE TO RELATED APPLICATION

This application claims the benefit of U.S. Provisional Patent Application No. 63/050,872, filed Jul. 12, 2020, which is incorporated by reference herein in its entirety.

TECHNICAL FIELD

The present disclosure relates generally to picture frames and more specifically to convertible display assemblies.

BACKGROUND

Advertising is important to all businesses but presents unique problems for the owners of small or local establishments. Media advertising is expensive and must compete for attention with the ads of others, most of whom are likely not local, and requires a potential customer to be watching television or reading internet programming to become aware of the ad. Likewise, print advertising requires a potential customer to read the ad in order to become aware of it. Point of sale advertising can inform a customer of special sales or offers if the customer is already in the store but does not have the impact or coverage of media or print advertising.

Local or "neighborhood" businesses are often found in neighborhoods and strip malls comprising a number of small businesses sharing a common parking lot or along streets bordering residential neighborhoods. The term "neighborhood business" is intended to identify individual locations, not necessarily businesses limited to a selected amount of commercial activity. For example, franchised store locations may do a high volume of business yet are "neighborhood" because much of their business comes from customers living nearby.

It is an advantage for neighborhood businesses to provide information to their customers about other neighborhood businesses. A customer in one local store will thus see information about another local store that is nearby, perhaps in the same strip mall, that will prompt the customer to stop at that second local store to purchase something the customer otherwise may not have chosen to do. Store owners and employees also benefit from learning about the stores located near theirs, making it more likely that customers at one store will be referred to another, nearby store, benefiting the neighborhood as a whole.

However, typical message board systems are too limiting. Most can be installed in only one way. In addition, many do not allow easy switching of one image for another. The present disclosure describes a convertible display assembly.

SUMMARY OF THE DISCLOSURE

In one aspect of the present disclosure, a convertible display assembly for a display item is disclosed. The convertible display assembly may include a display sleeve configured to receive the display item, a connector attached to a rear surface of the display sleeve, wherein the connector and the display sleeve define a connector plate cavity therebetween having a connector plate opening, and a support bracket having a connector plate. The connector plate may be inserted through the connector plate opening and into the connector plate cavity to demountably attach the display sleeve to the support bracket.

In another aspect of the present disclosure, a convertible display assembly for a display item is disclosed. The convertible display assembly may include a support bracket having a bracket base and a connector plate operatively connected to the bracket base, a display sleeve defining a display item cavity for receiving the display item therein, and a connector attached to a rear surface of the display sleeve. The connector and the display sleeve may define a connector plate cavity therebetween having a connector plate opening, and the connector plate may be received through the connector plate opening into the connector plate cavity to mount the display sleeve to the support bracket.

In a further aspect of the present disclosure, a convertible display assembly for a display item convertible display assembly is disclosed. The convertible display assembly may include a support bracket having a bracket base, at least one strut extending from the bracket base, and a connector plate extending from an end of the at least one strut opposite the bracket base. The convertible display assembly may further include a display sleeve having a front planar sheet and a rear planar sheet attached to the front planar sheet along at least one closed edge and defining a display item cavity between the front planar sheet and the rear planar sheet, the display sleeve having an open edge where the front planar sheet is not attached to the rear planar sheet such that the display item is inserted into the display item cavity through the open edge. The convertible display assembly may also include a connector attached to the rear planar sheet of the display sleeve. The connector and the rear planar sheet may define a connector plate cavity therebetween having a connector plate opening, and the connector plate may be received through the connector plate opening into the connector plate cavity to mount the display sleeve to the support bracket.

Additional aspects are defined by the claims of this patent.

DETAILED DESCRIPTION

Figure 1:
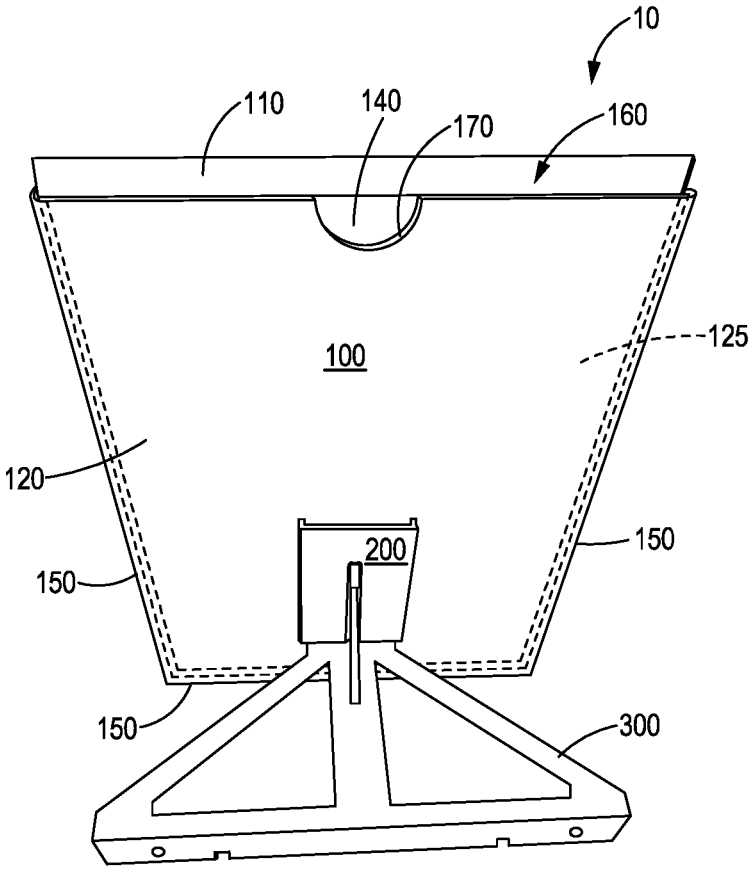
FIG. 1 is a rear perspective view of an embodiment of a convertible display assembly in accordance with the present disclosure.

Referring to FIG. 1, a convertible display assembly 10 in accordance with the present disclosure is illustrated. The convertible display assembly 10 may include three major parts: a display sleeve 100, a connector 200, and a support bracket 300 that is engaged by the connector 200 to connect the support bracket 300 to the display sleeve 100 such that the display sleeve 100 can be easily disconnected from the support bracket 300 in order to remove or insert a display item 140 disposed in the display sleeve 100.

The display sleeve 100 (FIGS. 1 and 2) consists of a front planar sheet 110 and a rear planar sheet 120 which define a generally flat display item cavity 125 therebetween into which the display item 140, such as an advertisement flyer, price list or photograph, may be inserted for display. The front planar sheet 110 and the rear planar sheet 120 are attached along at least one closed edge 150. The front planar sheet 110 and the rear planar sheet 120 are not attached along at least one open edge 160 of the display sleeve 100 to allow the display item 140 to be inserted or removed. The open edge 160 may include a notch 170 in the rear planar sheet 120 as shown and/or the front planar sheet 110 so that the display item 140 may be grasped for easier removal. The notch 170 may be semi-circular or any other suitable shape. The display item 140 may be card, paper, or other similar thin sheet material with an image or text to be displayed. At least the front planar sheet 110 is made of a transparent material such as clear plastic or glass. The rear planar sheet 120 may also be transparent, but may also be opaque, and may be fabricated from another suitable material. In the illustrated embodiment, the planar sheets 110, 120 are formed as a single unitary component fabricated from a transparent material. The display sleeve 100 may be generally rectangular. In some embodiments, the display sleeve 100 may be configured to display an item with a standard paper or poster size such as 4 by 6 inches, 8 by 11 inches, 11 by 17 inches, or 18 by 24 inches.

Figure 2:
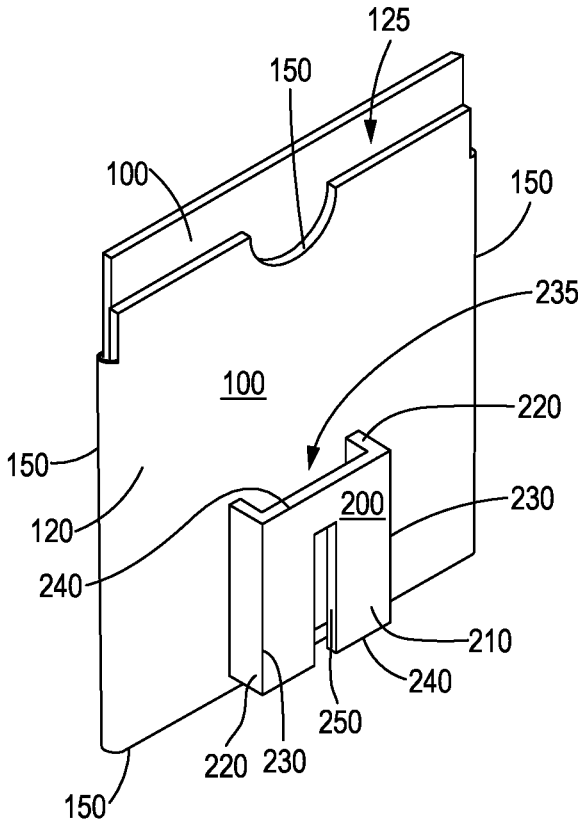
FIG. 2 is a rear right isometric view of a display sleeve and a connector of the convertible display assembly of FIG. 1.

The connector 200 is attached to the rear planar sheet 120 of the display sleeve 100. The connector 200 allows the support bracket 300 to be connected to the display sleeve 100. The connector 200 may be attached in any location on the rear planar sheet 120 so that the display sleeve 100 will be properly oriented when attached to the support bracket 300. In the illustrated embodiment, the connector 200 is attached near the center of the bottom closed edge 150 of the display sleeve 100 so that a majority of the display sleeve 100 is above the connector 200 and the support bracket 300 as seen in FIG. 1. The connector 200 includes of a rectangular connector base 210 with projections 220 extending outward along opposite lateral edges 230 at right angles to the connector base 210, as shown in FIG. 2. The projections 220 attach to the rear planar sheet 120 of the display sleeve 100 such that a shallow rectangular connector plate cavity 235 is formed between the connector base 210 and the rear planar sheet 120 with connector plate openings at the edges 240 without the projections 220. One edge 240 of the connector 200 may be parallel to the closest closed edge 150 of the display sleeve 100. A slot 250 may be cut into the connector base 210 from the center of the bottom edge 240 toward the upper edge 240. In one embodiment, the connector 200 may be approximately 2 inches along the upper and lower edges 240 and approximately 3.5 inches along the lateral edges 230. The projections 220 may be 0.25 inches. The slot 250 may be 0.12 inches wide and 2.5 inches long. Of course, other sizes may be used as suited to the size of the display sleeve 100.

Figure 3:
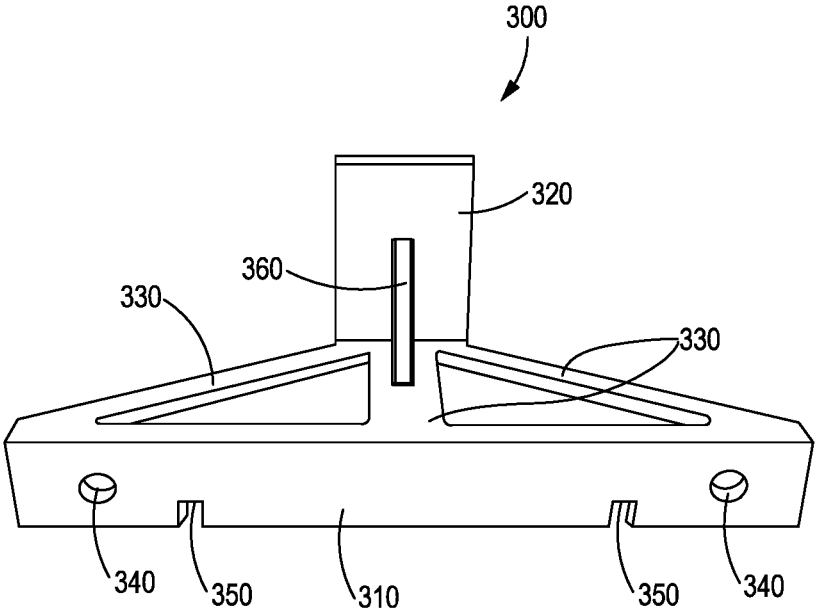
FIG. 3 is a rear isometric view of a support bracket of the convertible display assembly of FIG. 1.

As shown in FIG. 3, the support bracket 300 may include three elements: a bracket base 310, a connector plate 320, and one or more struts 330. The bracket base 310 is configured to support the display sleeve 100 in a generally upright and visible angle. The bracket base 310 may be designed to attach to a structure such as a flat wall, a machine, a link of a dry cleaning conveyor or the like, or to stand on a horizontal surface such as a counter. In the illustrated embodiment, the bracket base 310 includes mounting holes 340 through which mounting screws, nails or other hardware may be threaded and tightened, and downward facing mounting slots 350 that may receive hooks, nails, zip ties or other mounting structures to hang the support bracket 300. The connector plate 320 is located opposite the bracket base 310 and extends upward from the struts 330 connecting the connector plate 320 to the bracket base 310. The connector plate 320 is sized to be inserted through the connector plate opening at the bottom edge 240 of the connector 200 and to fit within the connector plate cavity 235 between the rear planar sheet 120 and the connector base 210. A gusset 360 may extend between the connector plate 320 and a central one of the struts 330 to provide additional structural support for the connector plate 320 and the display sleeve 100. When the connector plate 320 is inserted into the connector plate cavity 235, the gusset 360 may be received by the slot 250 to allow full insertion of the connector plate 320.

Figure 4:
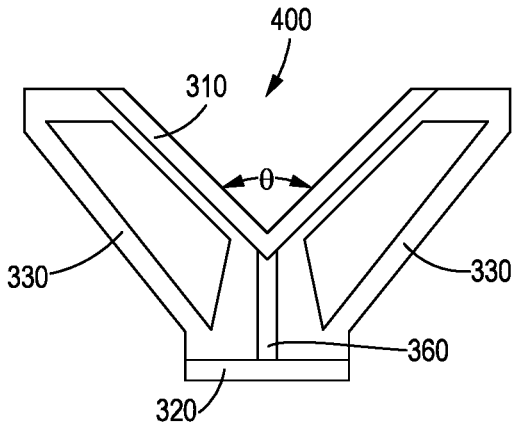
FIG. 4 is a top view of a corner support bracket of an alternative embodiment of a convertible display assembly in accordance with the present disclosure.
Figure 5:
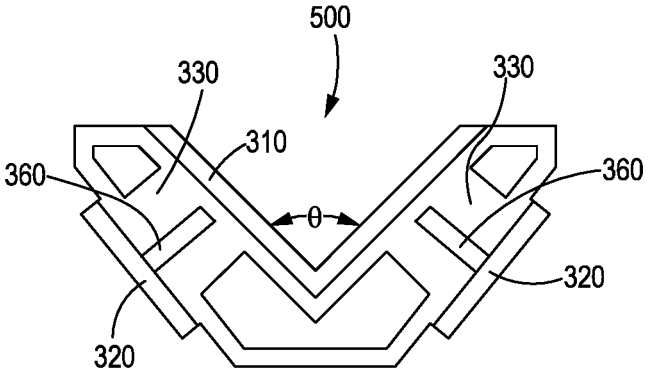
FIG. 5 is a top view of an alternative embodiment of a corner support bracket in accordance with the present disclosure.

FIGS. 4 and 5 illustrate alternative embodiments of support brackets 400, 500 that are configured for mounting the convertible display assembly 10 at the intersection of two surfaces. Structures of the support brackets 400, 500 that correspond to structures in the support bracket 300 are identified using the same reference numerals. Referring to FIG. 4, the bracket base 310 forms an angle Θ that corresponds to an angle formed between the intersecting surfaces to which the bracket base 310 will be mounted. The connector plate 320 is mounted by the struts 330 opposite the angle Θ so that the display sleeve 100 may face outward from the corner formed by the intersecting surfaces. In the embodiment of the support bracket 500 shown in FIG. 5, a first connector plate 320 is located on a first side of the support bracket 500 so that the corresponding display sleeve 100 faces outward from a first one of the intersecting surfaces, and a second connector plate 320 is located on a second side of the support bracket 500 so that the corresponding display sleeve faces outward from a second one of the intersecting surfaces.

As discussed, in order to connect the display sleeve 100 to one of the support brackets 300, 400, 500, the corresponding connector plate 320 is inserted into the connector plate cavity 235 of the connector 200 such that the gusset 360 extends through the slot 250 and secures the display sleeve 100 in place. The display sleeve 100 may be lifted off the support at any time to easily replace the display item 140. If the support bracket 300, 400, 500 is mounted on a wall or other structure, replacement of the display item 140 may be accomplished without the need to detach the support bracket 300, 400, 500 from the structure. In some embodiments, other decorative features may be added to the convertible display assembly 10. For example, a picture frame or other design elements may be attached to the front planar sheet 110 while still allowing the display item 140 to be visible external to the convertible display assembly 10.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A convertible display assembly for a display item, the convertible display assembly comprising:

a display sleeve configured to receive the display item;

a connector attached to a rear surface of the display sleeve, wherein the connector and the rear surface of the display sleeve define a connector plate cavity therebetween having a shallow rectangular shape and a connector plate opening disposed at a bottom edge of the connector; and a support bracket having a connector plate extending upward from the support bracket, wherein the connector plate is rectangular, is inserted upward through the connector plate opening and into the connector plate cavity to temporarily attach the display sleeve to the support bracket and prevents rotation of the display sleeve relative to the support bracket when the connector plate is inserted into the connector plate cavity.

2. The convertible display assembly according to claim 1, wherein the display sleeve is fabricated from a transparent material.

3. The convertible display assembly according to claim 1, wherein the display sleeve comprises:

a front planar sheet; and a rear planar sheet attached to the front planar sheet along at least one closed edge and defining a display item cavity between the front planar sheet and the rear planar sheet, the display sleeve having an open edge where the front planar sheet is not attached to the rear planar sheet such that the display item is inserted into the display item cavity through the open edge.

4. The convertible display assembly according to claim 1, wherein the display sleeve includes a front planar sheet and a rear planar sheet attached to the front planar sheet to define a display item cavity therebetween, wherein the connector comprises:

a connector base; and projections extending outward from opposite lateral edges of the connector base, wherein the projections are connected to the rear planar sheet of the display sleeve such that the connector base, the projections and the rear planar sheet define the connector plate cavity.

5. The convertible display assembly according to claim 1, wherein the connector has a slot that is cut therethrough and extending upward from the bottom edge, and wherein the support bracket comprises:

a bracket base having the connector plate operatively connected thereto; and a gusset extending from a rear surface of the connector plate and providing structural support to the connector plate, wherein the gusset is received within the slot when the connector plate is inserted upward into the connector plate cavity through the connector plate opening.

6. The convertible display assembly according to claim 1, wherein the support bracket comprises:

a bracket base; and at least one strut extending from the bracket base and having the connector plate extending from the at least one strut opposite the bracket base.

7. A convertible display assembly for a display item, comprising:

a support bracket having a bracket base and a connector plate operatively connected to the bracket base and extending upward from the bracket base;

a display sleeve defining a display item cavity for receiving the display item therein; and a connector attached to a rear surface of the display sleeve, wherein the connector and the rear surface of the display sleeve define a connector plate cavity therebetween having a shallow rectangular shape and a connector plate opening disposed at a bottom edge of the connector, wherein the connector plate is rectangular, is received through the connector plate opening and upward into the connector plate cavity to mount the display sleeve to the support bracket and prevents rotation of the display sleeve relative to the support bracket when the connector plate is inserted into the connector plate cavity.

8. The convertible display assembly according to claim 7, wherein the bracket base has a planar surface for attachment to a corresponding planar surface to mount the convertible display assembly to a wall of a structure.

9. The convertible display assembly according to claim 7, wherein the bracket base defines a bracket base angle that corresponds to a surface angle between two intersecting surfaces to which the support bracket will be mounted.

10. The convertible display assembly according to claim 9, wherein the bracket base angle is 90°.

11. The convertible display assembly according to claim 9, wherein the connector plate is operatively connected to the bracket base opposite the bracket base angle so that the connector plate is facing outward from a corner formed by the two intersecting surfaces.

12. The convertible display assembly according to claim 9, wherein the connector plate comprises:

a first connector plate operatively connected to a first side of the bracket base so that the first connector plate is facing outward from a first intersecting surface of the two intersecting surfaces, wherein the first connector plate extends upward from the first side of the bracket base; and a second connector plate operatively connected to a second side of the bracket base so that the second connector plate is facing outward from a second intersecting surface of the two intersecting surfaces, wherein the second connector plate extends upward from the second side of the bracket base.

13. The convertible display assembly according to claim 12, wherein the display sleeve comprises a first display sleeve defining a first display item cavity for receiving a first display item therein and a second display sleeve defining a second display item cavity for receiving a second display item therein, and wherein the connector comprises:

a first connector attached to a first rear surface of the first display sleeve, wherein the first connector and the first rear surface of the first display sleeve define a first connector plate cavity therebetween having a first connector plate opening disposed at a first bottom edge of the second connector, wherein the first connector plate is received through the first connector plate opening and upward into the first connector plate cavity to mount the first display sleeve to the support bracket; and a second connector attached to a second rear surface of the second display sleeve, wherein the second connector and the second rear surface of the second display sleeve define a second connector plate cavity therebetween having a second connector plate opening disposed at a second bottom edge of the second connector, wherein the second connector plate is received through the second connector plate opening and upward into the second connector plate cavity to mount the second display sleeve to the support bracket.

14. A convertible display assembly for a display item, comprising:

a support bracket having a bracket base, at least one strut extending from the bracket base, and a connector plate extending upward from an end of the at least one strut opposite the bracket base;

a display sleeve having a front planar sheet and a rear planar sheet attached to the front planar sheet along at least one closed edge and defining a display item cavity between the front planar sheet and the rear planar sheet, the display sleeve having an open edge where the front planar sheet is not attached to the rear planar sheet such that the display item is inserted into the display item cavity through the open edge; and a connector attached to the rear planar sheet of the display sleeve, wherein the connector and the rear planar sheet define a connector plate cavity therebetween having a shallow rectangular shape and a connector plate opening disposed at a bottom edge of the connector, wherein the connector plate is rectangular, is received through the connector plate opening and upward into the connector plate cavity to mount the display sleeve to the support bracket and prevents rotation of the display sleeve relative to the support bracket when the connector plate is inserted into the connector plate cavity.

15. The convertible display assembly according to claim 14, wherein the connector comprises:

a connector base; and projections extending outward from opposite lateral edges of the connector base, wherein the projections are connected to the rear planar sheet of the display sleeve such that the connector base, the projections and the rear planar sheet define the connector plate cavity.

16. The convertible display assembly according to claim 14, wherein the connector has a slot that is cut therethrough and extending upward from the bottom edge, and wherein the support bracket comprises a gusset extending between a rear surface of the connector plate and the at least one strut to provide structural support to the connector plate, wherein the gusset is received within the slot when the connector plate is inserted upward into the connector plate cavity through the connector plate opening.

17. The convertible display assembly according to claim 14, wherein the bracket base defines a bracket base angle that corresponds to a surface angle between two intersecting surfaces to which the support bracket will be mounted.

18. The convertible display assembly according to claim 17, wherein the at least one strut comprises a first strut extending outward from a first side of the bracket base and outward from a first intersecting surface of the two intersecting surfaces, and a second strut extending outward from a second side of the bracket base and outward from a second intersecting surface of the two intersecting surfaces, and wherein the connector plate comprises a first connector plate extending from the first strut so that the first connector plate is facing outward from the first intersecting surface and a second connector plate extending from the second strut so that the second connector plate is facing outward from the second intersecting surface.

19. The convertible display assembly according to claim 14, wherein the front planar sheet and the rear planar sheet of the display sleeve are integrally formed as a single unitary component from a transparent material.

* * * * *